US006585025B2

(12) United States Patent
Welfonder

(10) Patent No.: US 6,585,025 B2
(45) Date of Patent: Jul. 1, 2003

(54) RELEASABLE END STOP

(75) Inventor: Konrad Welfonder, Bremerhaven (DE)

(73) Assignee: Hunter Douglas Industries B.V. (NL)

( * ) Notice: Subject to any disclaimer, the term of this patent is extended or adjusted under 35 U.S.C. 154(b) by 0 days.

(21) Appl. No.: 09/738,660

(22) Filed: Dec. 14, 2000

(65) Prior Publication Data

US 2001/0011582 A1 Aug. 9, 2001

(30) Foreign Application Priority Data

Dec. 14, 1999 (EP) ..... 99204295

(51) Int. Cl.[7] ..... E06B 9/30
(52) U.S. Cl. ..... 160/168.1 V; 160/178.1 V
(58) Field of Search ..... 160/178.1 V, 177 V, 160/176.1 V, 172 V, 168.1 V, 173 V, 900

(56) References Cited

U.S. PATENT DOCUMENTS

| | | | | | |
|---|---|---|---|---|---|
| 3,157,223 | A | | 11/1964 | Arena et al. | 160/168.1 |
| 4,335,775 | A | | 6/1982 | Frentzel et al. | 160/177 |
| 4,425,955 | A | * | 1/1984 | Kaucic | 160/168.1 V |
| 4,559,670 | A | | 12/1985 | Wyatt | 16/87.2 |
| 4,732,202 | A | | 3/1988 | Anderson | 160/168.1 |
| 4,750,539 | A | * | 6/1988 | Chang | 160/178.1 V |
| 4,848,434 | A | * | 7/1989 | Morris et al. | 160/178.1 V |
| 4,887,657 | A | | 12/1989 | Spohr | 160/178.1 |
| 5,090,467 | A | * | 2/1992 | Smuckler | 160/178.1 V |
| 5,092,386 | A | | 3/1992 | Spohr et al. | 160/173 |
| 5,351,741 | A | * | 10/1994 | Swopes | 160/168.1 |
| 5,445,205 | A | * | 8/1995 | Hansen | 160/168.1 V |

FOREIGN PATENT DOCUMENTS

| | | |
|---|---|---|
| DE | 36 20 039 | 12/1987 |

* cited by examiner

*Primary Examiner*—David M. Purol
(74) *Attorney, Agent, or Firm*—Dorsey & Whitney LLP

(57) ABSTRACT

A releasable end stop is provided for an assembly of carriers and spacers that can be moved longitudinally within a head rail of an architectural covering, such as a covering for an architectural opening, and particularly a vertical venetian blind, wherein the end stop permits movement of operative components of the covering to permit cleaning and servicing of the control system for the covering.

19 Claims, 6 Drawing Sheets

RELEASABLE END STOP

BACKGROUND OF THE INVENTION

1. Field of the Invention

This invention relates to a releasable end stop for an assembly of carriers and spacers that can be moved longitudinally within a head rail of an architectural covering, such as a covering for an architectural opening, like a window or door, particularly a vertical venetian blind, in order to open and close the covering.

2. Description of the Relevant Art

Vertical venetian blinds have generally been provided with horizontally-extending head rails, holding a plurality of carriers or travellers that can be moved in spaced apart relationship along the longitudinal length of each head rail. Each carrier has typically supported a vertically-extending louver or slat in such a manner that the consumer of the venetian blind could: i) move the louver along the head rail (e.g., by pulling on a first operating cord or pull cord attached to an active end of the head rail); and ii) also rotate or tilt the louver about its vertical axis (e.g., by pulling on a second operating cord or tilt cord).

The carriers in the head rails of vertical blinds have also generally been provided with a plurality of longitudinally-extending spacers which keep the carriers and the louvers, supported by the carriers, in spaced-apart relationship when the carriers and louvers are moved longitudinally along the head rail, apart from each other, to close the blinds and cover their windows. Typically, the closed end or leading end of each spacer has been slidably positioned on a smooth horizontal surface within a longitudinally-extending channel or groove of a leading carrier and the open end or trailing end of the spacer has been fixed to an adjacent trailing carrier. See, for example, the carriers and their spacers in U.S. Pat. No. 5,092,386, U.S. Pat. No. 4,887,657, U.S. Pat. No. 4,732,202, U.S. Pat. No. 4,559,670 and U.S. Pat. No. 4,335,775.

The most trailing spacer on the most trailing carrier has typically been affixed to the active end of the head rail to keep the most trailing spacer from moving away from the active end (towards the passive other end of the head rail) when the blind has been closed. This has made it difficult to service and clean the parts of the head rail, adjacent the active end. This is because the most trailing carriers, spacers and slats have tended to block access to the head rail adjacent its active end and have not been easy to displace, even temporarily, away from the active end (i.e., longitudinally towards the passive end).

In order to be able to move the most trailing carriers and slats away from the active end of the head rails of vertical blinds, releasable connections have been provided between the most trailing carriers and the active ends of the head rails. See DE 36 20 039, U.S. Pat. No. 3,157,223 and U.S. Pat. No. 5,351,741. However, such releasable connections have not been entirely satisfactory since the most trailing carriers and slats of each such vertical blind have then had to be gripped, by hand, so that they could be moved away from the active end after the most trailing carrier had been released from the active end of its blind.

SUMMARY OF THE INVENTION

In accordance with one aspect of this invention, a releasable end stop is provided for an assembly of carriers and spacers that can be moved longitudinally within a head rail of an architectural covering, such as a covering for an architectural opening, particularly a vertical venetian blind, to open and close the covering; the end stop comprising:

a longitudinally-movable release plate, in the head rail, that is between an active end cap and a trailing spacer of a most trailing carrier and that is affixed to a trailing end of the trailing spacer of the most trailing carrier; and a longitudinally-extending, flexible resilient tongue that is on the active end cap and is adapted to detachably hold the release plate against movement of the release plate away from the active end cap with longitudinal movement of the spacers and carriers away from the active end cap.

With this releasable end stop, the most trailing carriers and slats can be moved easily away from the active end of the head rails of vertical blinds to clean or service the active end, simply by pushing the release plate away from the active end.

Advantageously, the releasable end stop comprises a pair of tongues that are on a laterally-extending first end surface of an end plug of the active end cap; the first end surface being adjacent to the release plate. Especially advantageous is that the tongues are vertically aligned with each other and with a pair of vertically-aligned, horizontal surfaces of the release plate. Also especially advantageous is that each tongue has a hook at a leading edge, and the hooks extend towards each other, particularly where at least one of the tongues can be flexed vertically so that its hook is moved vertically, whereby a horizontal surface of the release plate can then be moved longitudinally over or under the hook to attach or detach the release plate and the end plug, quite particularly where a laterally-extending second end surface of the release plate has a pair of mating, vertically aligned, first notches, adjacent the horizontal surfaces where the first notches can be engaged and held by the hooks by moving the release plate longitudinally against the end plug. Also particularly advantageous is that both, of the tongues are highly flexible, so that the tongues can be flexed vertically to move their hooks vertically apart, whereby the horizontal surfaces of the release plate can then be moved longitudinally over or under the hooks to attach or detach the release plate from the hooks, by pushing on one vertical side of the release plate in a direction longitudinally away from the active end cap.

Also advantageously, there is a downwardly- and laterally-extending tab on the underside of the release plate. Further advantageously, there is a longitudinally extending hole through the release plate to accommodate draw cords. Yet further advantageously, there is a longitudinally-extending smooth second notch through a rear portion of the release plate to accommodate a tilt rod mounting member. Still further advantageously, there is a frontally-extending projection on a front surface of the release plate, and the bottom of the projection is horizontal and smooth, so that it can slide along a longitudinally-extending track on the front of the interior of the head rail when the release plate is moved longitudinally.

Other aspects of the invention include a head rail for an architectural covering, including this releasable end stop and an architectural covering, particularly a vertical Venetian blind, including this head rail.

Further aspects of the invention will be apparent from the detailed description below of particular embodiments and the drawings.

DESCRIPTION OF THE PREFERRED EMBODIMENTS

Figure 1:
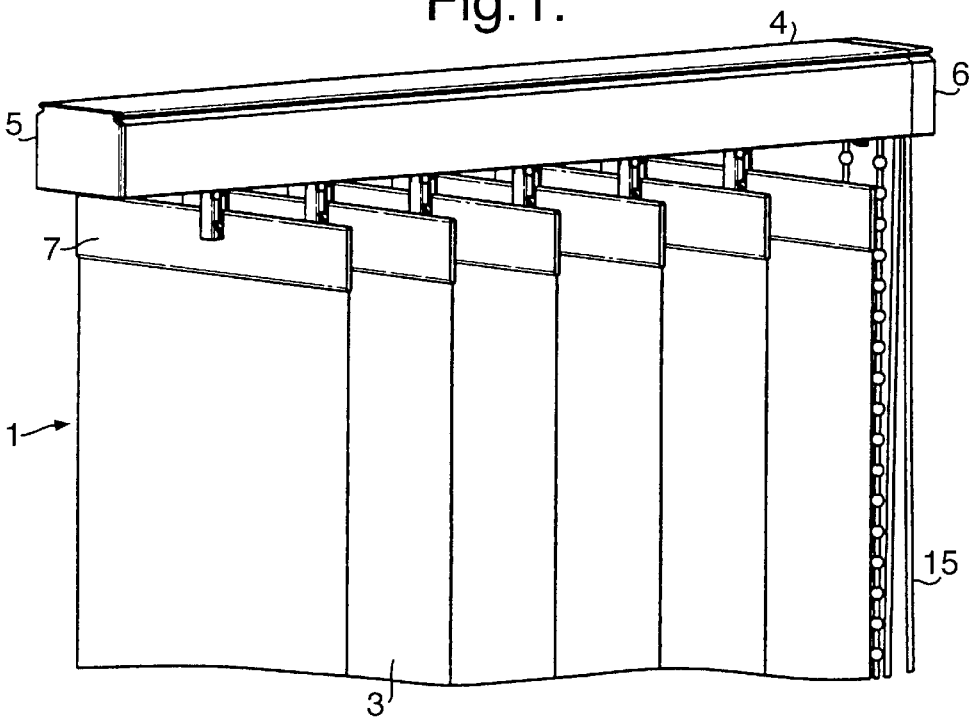
FIG. 1 is a perspective view, showing the front, passive end and top of a vertical venetian blind of this invention, when closed.
Figure 2:
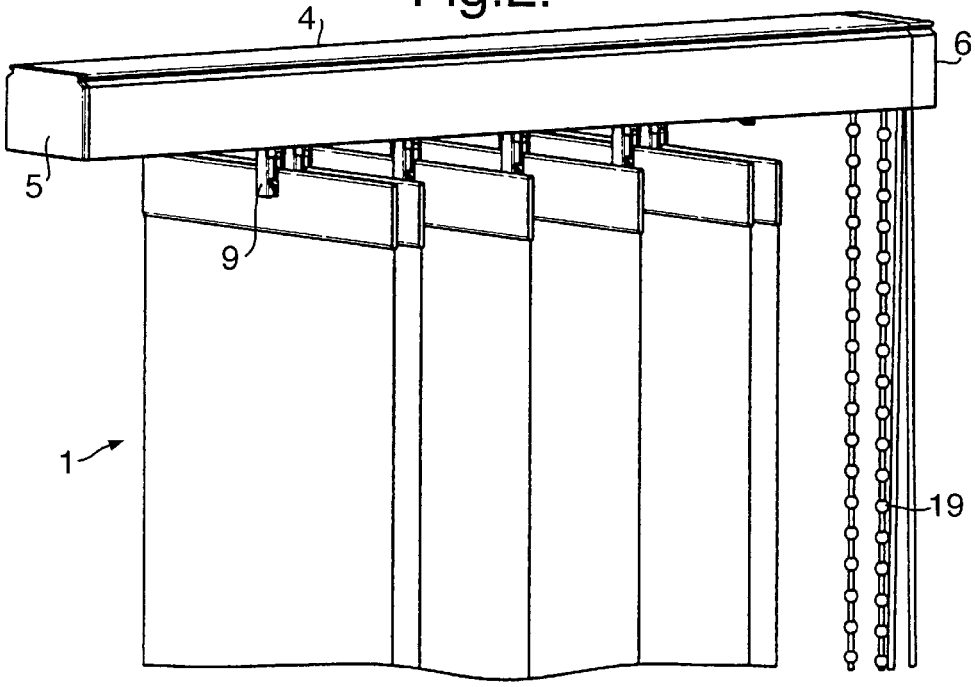
FIG. 2 is a perspective view, showing the front, passive end and top of the vertical blind, when closed, with its most trailing carrier moved away from its end plug.
Figure 3:
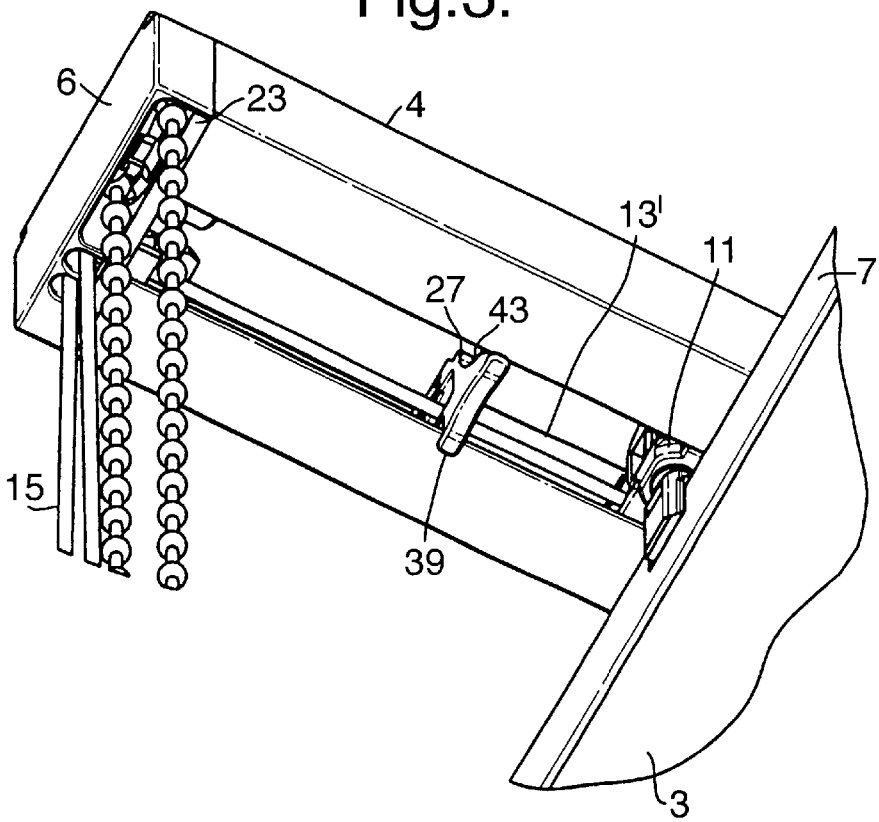
FIG. 3 is a perspective view, showing the rear, active end and bottom of the vertical blind, as shown in FIG. 2, with its detachable release plate and its most trailing carrier moved away from an end plug of its active end cap.
Figure 4:
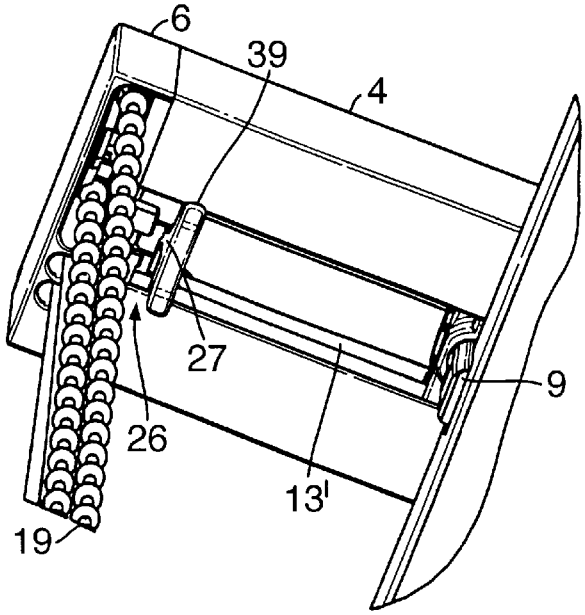
FIG. 4 is a perspective view, showing the rear, active end and bottom of the vertical blind, as shown in FIG. 1, with its detachable release plate moved adjacent to its active end plug.
Figure 5:
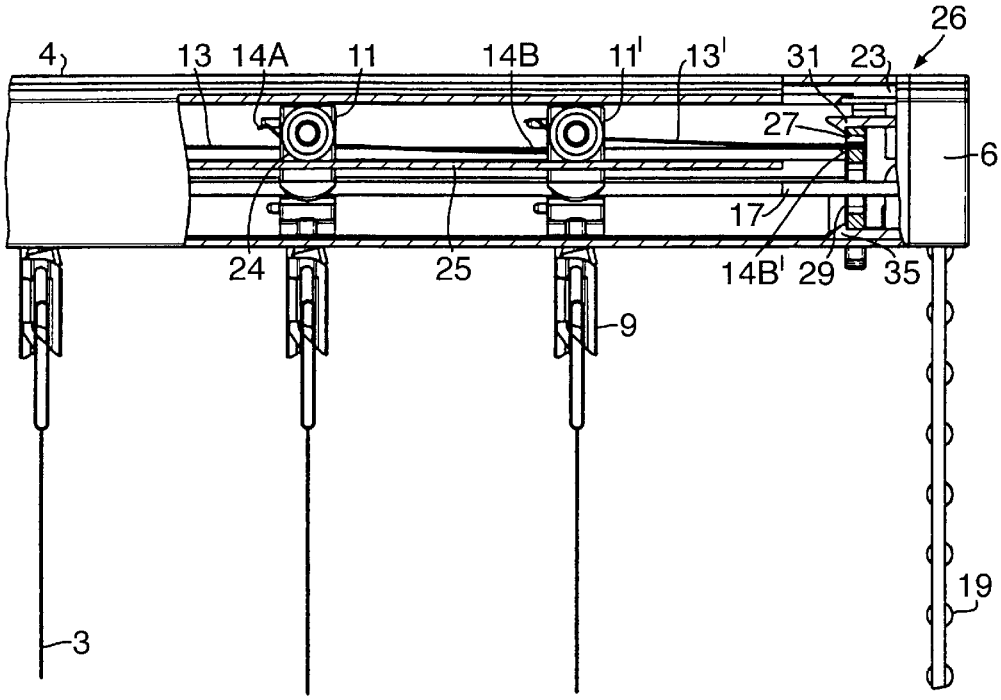
FIG. 5 is a partial sectional view of the vertical blind, as shown in FIGS. 1 and 4, with its detachable release plate held by flexible resilient tongues on its active end plug.
Figure 6:
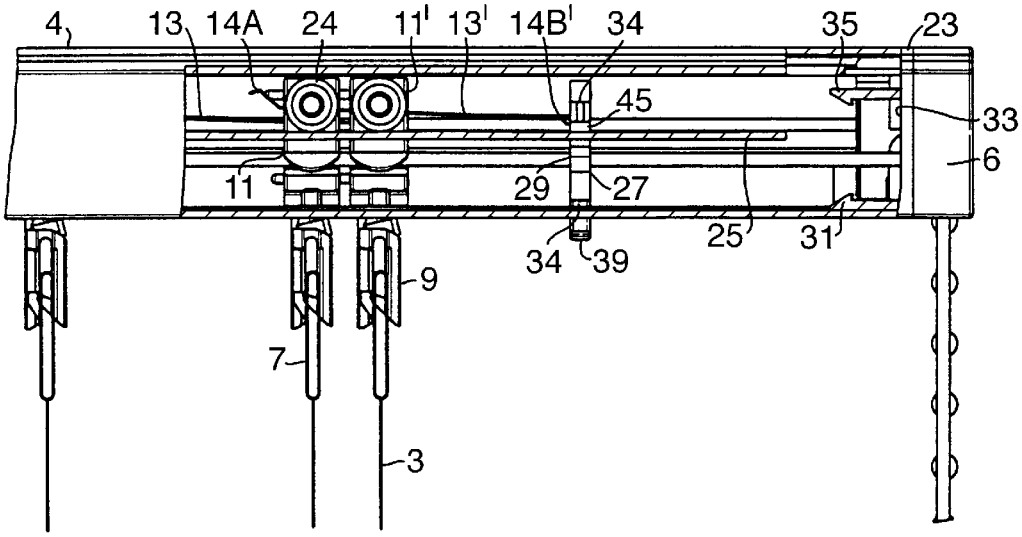
FIG. 6 is a partial sectional view of the vertical blind, as shown in FIGS. 2 and 3, with its detachable release plate moved away from the flexible resilient tongues on its active end plug.

FIGS. 1–10 show a vertical blind 1 having a plurality of conventional (metal, plastic or fabric) vertical louvers or slats 3 suspended from its horizontally- and longitudinally-extending head rail 4. Passive and active end caps 5 and 6, respectively, are provided on opposite longitudinal ends of the head rail 4. An upper marginal portion 7 of each louver 3 is securely suspended vertically from a conventional (preferably plastic) holder 9, each supported by a conventional (preferably plastic) carrier, generally 11, within the head rail 4.

As shown in FIGS. 3–8 and 10, a pair of conventional (preferably thin, stainless steel or plastic), longitudinally-extending elongate spacers, generally 13, are attached to each spacer carrier 11. In this regard, the leading end 14A of one spacer 13 has been slidably positioned on a smooth surface of each carrier 11, and the trailing end 14B of the other spacer 13 has been fixed to the carrier. Thereby, the spacers 13 keep the carriers 11 in longitudinally spaced-apart relationship when the carriers are moved longitudinally: i) from an open position, in which they are stacked adjacent the active end cap 6 when the blind 1 is open, ii) towards the passive end cap 5 and a closed position, in which the carriers are spread apart along the length of the head rail 4 when the blind 1 is closed.

As also shown in FIGS. 1–8, a conventional pull cord 15 is provided within the active end cap 6. The pull cord 15 is connected by longitudinally-extending draw cords 17 (shown in FIGS. 7–8) to a leading carrier (not shown) that is closest to the passive end cap 5. The pull cord 15 is adapted to: i) pull the leading carrier toward the passive end cap 5 and thereby pull all the other carriers 11 and the spacers 13 towards the passive end cap to close the blind 1; and ii) also to pull the leading carrier towards the active end cap 6 and thereby to pull the other carriers and spacers towards the active end cap 6 so as to open the blind 1. The active end cap 6 also holds a conventional bead chain 19 which serves as a tilt cord for rotating a conventional longitudinally-extending grooved tilt rod 21 (also shown in FIGS. 7–8) of the head rail 4, so as to tilt the holders 9 and thereby tilt their louvers 3.

As further shown in FIGS. 3–8 and 10, the active end cap 6 includes an end plug 23 inserted in the active end of the head rail 4. The active end plug 23 includes conventional longitudinally-extending openings, through which the draw cords 17 can pass to the pull cord 15 and through which the tilt rod 21 can pass to a conventional pulley (not shown), around which the bead chain 19 is wound.

As still further shown in FIGS. 5–8 and 10, each carrier 11 has a pair of conventional rollers or wheels 24 on its front and rear. The carrier moves on the rollers 24 along longitudinally-extending tracks 25 on the front and rear of the interior of the head rail 4, along its length, in response to movement of the pull cord 15 and draw cords 17.

Except as described below, the head rail 4 and its components are conventional. In this regard, the structure of the carriers 11, holders 9, spacers 13 and louvers 3 and their controlled longitudinal movement along the length of the head rail 4 and the controlled tilt of the holders 9 and louvers 3 are generally known (e.g., from U.S. Pat. Nos. 4,732,202 and 4,335,775).

In accordance with this invention, a releasable end stop, generally 26, is provided in the head rail 4 adjacent the active end cap 6. As shown in FIGS. 3–10, the releasable end stop 26 includes a longitudinally-movable release plate, generally 27, between the end plug 23 of the active end cap 6 and the trailing spacer 13' of the most trailing carrier 11' as shown in FIGS. 3–9. The trailing end 14B' of the trailing spacer 13' of the most trailing carrier 11' is affixed in a conventional manner to an adjacent, laterally-extending, first end surface 29 of the release plate 27.

Figure 7:
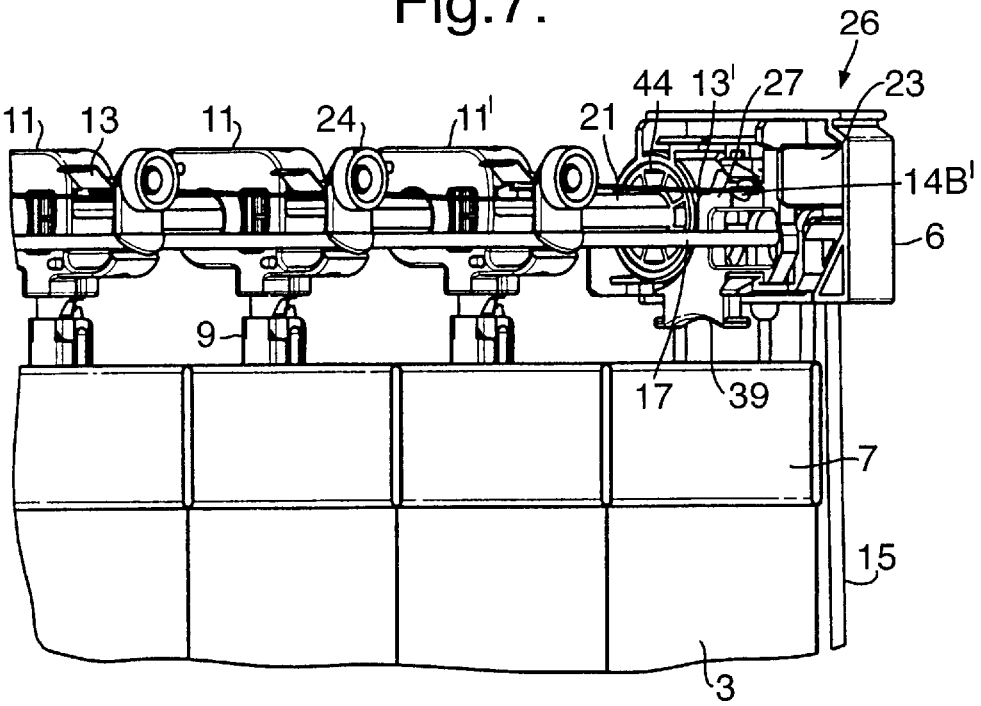
FIG. 7 is a perspective view of the vertical blind, as shown in FIGS. 1, 4 and 5, with its head rail removed and its detachable release plate held by the flexible resilient tongues on its active end plug.
Figure 8:
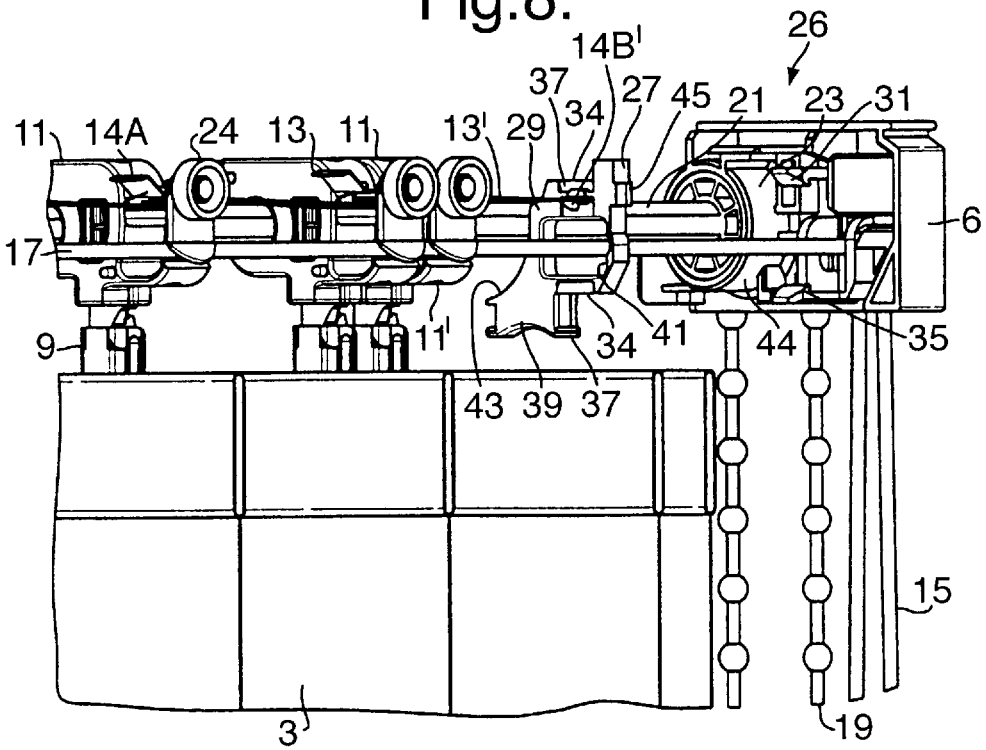
FIG. 8 is a perspective view of the vertical blind, as shown in FIGS. 2, 3 and 6, with its head rail removed and its detachable release plate moved away from the flexible resilient tongues on its active end plug.
Figure 9:
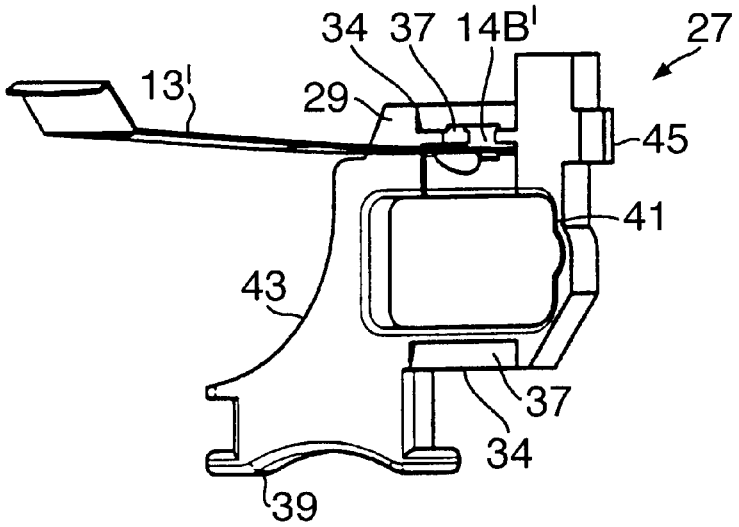
FIG. 9 is a perspective view of the detachable release plate attached to the trailing spacer of the most trailing carrier.
Figure 10:
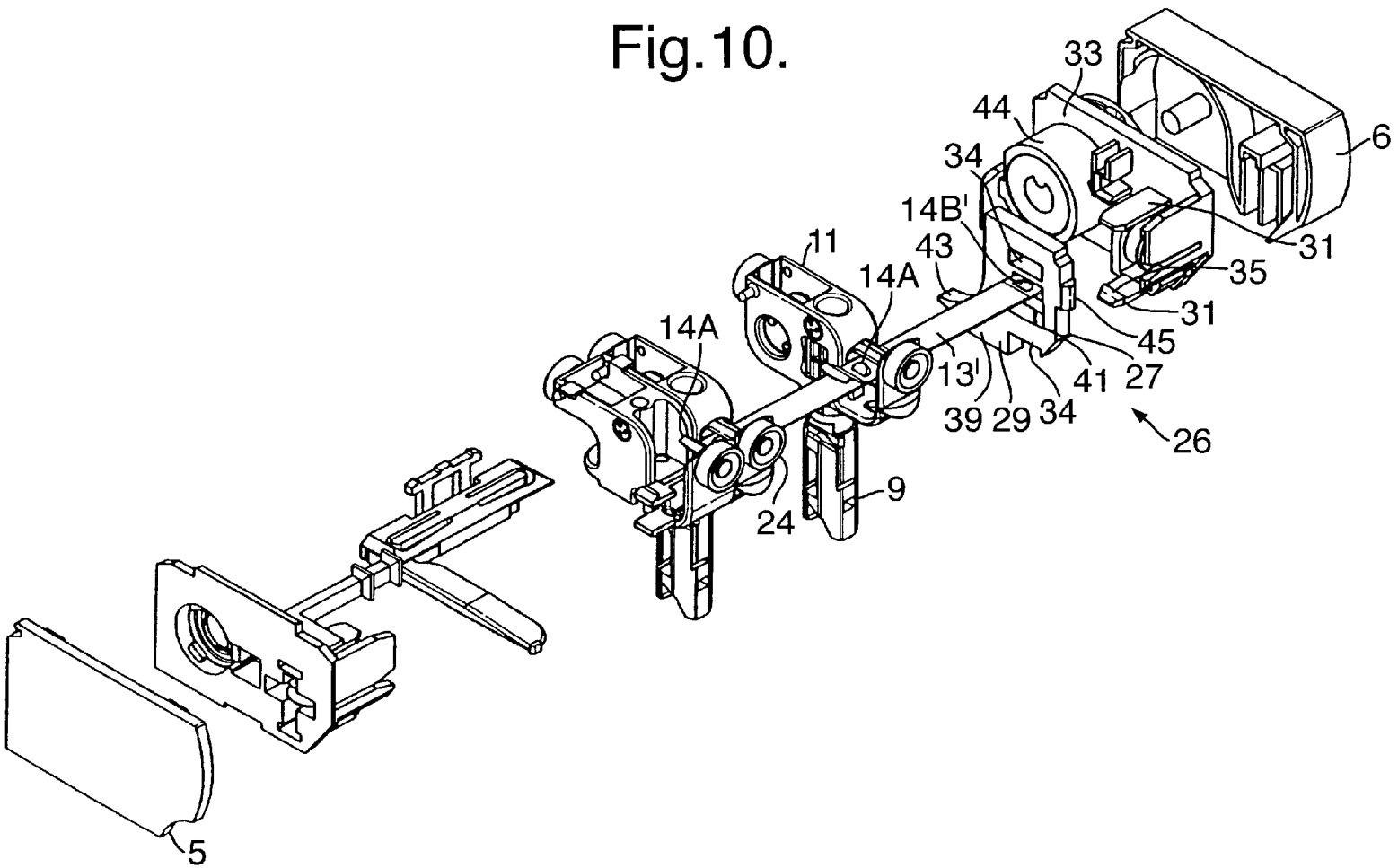
FIG. 10 is an exploded perspective view of the carriers, spacers, end plugs of the vertical blind of FIGS. 1–9, with a slightly modified detachable release plate.

In addition, the releasable end stop 26 includes a pair of longitudinally-extending, flexible resilient tongues, generally 31, on a laterally-extending second end surface 33 of the active end plug 23, adjacent the release plate 27 as shown in FIGS. 5–8 and 10. The tongues 31 are vertically aligned with each other and with a pair of vertically aligned horizontal surfaces 34 of the release plate 27. As shown in FIGS. 7 and 8, the horizontal surfaces 34 can be on the top and bottom of the release plate 27, or as shown in FIG. 9, one or both of such horizontal surfaces 34 can be within a longitudinally-extending hole through the release plate. Each tongue 31 has a hook 35 at its longitudinal end, adjacent the release plate 27, and the hooks 35 of the two tongues extend towards each other. The tongues 31 are adapted to be flexed vertically when the horizontal surfaces 34 of the release plate 27 are moved longitudinally above and below the hooks 35 on the lower and upper tongues respectively as described below, either: i) towards the active end plug 23 to attach the release plate to the active end plug or ii) away from the active end plug to detach the release plate from the active end plug. The hooks 35 are adapted to hold the release plate 27 adjacent the active end plug 23, against longitudinal movement of the release plate away from the active end cap 6 and towards the passive end cap 5 with longitudinal movement of the spacers 13 and carriers 11 away from the active end cap and towards the passive end cap to close the blind 1. As described below, the hooks 35 are also adapted to move vertically apart when their tongues 31 are flexed vertically, and thereby to become detached from the release plate 27 so that the release plate can be moved away from the active end cap 6.

As shown in FIGS. 7–9, a pair of mating, vertically-aligned, first notches 37 can be provided in the first end surface 29 of the release plate 27. Each notch is vertically adjacent one of the horizontal surfaces 34 of the release plate where it can be engaged and held by one of the hooks 35 on the flexible tongues 31 of the active end plug 23 simply by moving the release plate 27 longitudinally against the end plug 23. In this regard, the hooks 35 can engage and detachably hold the first notches 37 when moving the carriers 11 and louvers 3 towards the active end cap 6 to open the blind 1. However, as seen from FIG. 10, it is not necessary to provide such first notches 37 in the release plate, in order for it to be detachably held by the hooks 35.

As shown in FIGS. 5–10, a downwardly- and laterally-extending tab 39 is preferably provided on the bottom of the release plate 27 and preferably extends below the head rail 4. The tab 39 allows one to grasp easily the release plate 27, beneath the head rail 4, and push the release plate longitudinally away from the active end cap 6 to detach the release plate from the hooks 35 of the flexible tongues 31 of the active end plug. In this regard, pushing the tab 39 of the release plate 27 away from the active end cap 6 initially causes the upper horizontal surface 34 of the release plate to move along the bottom surface of the upper tongue 31 towards the active end cap 6 and to urge the upper tongue upwardly, as the bottom of the release plate is moved with the tab 39 away from the active end cap 6 and the lower horizontal surface 34 of the release plate moves over the lower hook 35. Then pushing the tab 39 of the release plate 27 further away from the active end cap 6 causes the lower horizontal surface 34 of the release plate 27 to move longitudinally away from the lower hook 35 and then moves the upper horizontal surface 34 of the release plate under and away from the upper hook 35 and away the active end cap 6. Once detached from both hooks 35, the release plate 27 can thereafter be moved longitudinally, with the adjacent carriers 11 and louvers 3, further away from the active end cap 6 in order to service or clean the active end of the head rail. Subsequently, the release plate 27 can be moved, with the adjacent carriers 11 and louvers 3, towards the active end cap 6 so that the release plate is engaged and held again by the hooks 35. This can be done simply by pulling on the pull cord 15 to open completely the blind 1. Preferably, the tongues 31 are made highly flexible, so that their hooks 35 are moved vertically in and out of engagement with the notches 37, to attach and detach the hooks from the release plate 27, and moved longitudinally above and below the horizontal surfaces 34 of the release plate without pushing too hard on the tab 39 or pulling too hard on the pull cord 15.

As shown in FIGS. 7–10, a longitudinally-extending hole 41 also is preferably provided through the release plate 27 to accommodate the draw cords 17.

In addition, a longitudinally-extending smooth second notch or groove 43 is preferably provided through a rear portion of the release plate 27 as shown in FIGS. 7–10. The second notch 43 accommodates a mounting member 44 for the tilt rod 21, which member extends longitudinally from the second end surface 33 of the active end plug 23.

Moreover, a frontally-extending projection 45 is provided on the front surface of the release plate 27 as shown in FIGS. 7–10. The bottom of the projection 45 is horizontal and smooth and is located so as to slide easily along the longitudinally-extending track 25 on the front of the interior of the head rail 4 when the release plate 27 is moved longitudinally. In this regard, the second notch 43 is preferably adapted also to slide easily along the tilt rod 21 when the release plate 27 is moved longitudinally.

This invention is, of course, not limited to the above-described embodiments which can be modified without departing from the scope of the invention or sacrificing all of its advantages. In this regard, the terms in the foregoing description and the following claims, such as "longitudinal", "lateral", "above", "below", "top", "bottom", "vertical", "horizontal", "front", "rear", "frontally" and "rearwardly", have been used only as relative terms to describe the relationships of the various elements of the releasable end stop for an assembly of carriers and spacers of a head rail of an architectural covering. For example, the louvers 3 of the vertical blinds 1 could be replaced by other vertical sections of an architectural covering, for example by: i) vertical sections of a conventional drapery fabric or a vaned fabric as described in PCT publication WO 96/35854 or ii) vertical vanes as described in PCT publication WO 96/35881. Likewise, the blind 1 could have two sets of louvers 3 and, at each longitudinal end, an active end cap 6 with a releasable end stop 26, so that the blind can be closed by moving the sets of louvers towards each other and towards the longitudinal center of the blind, and the blind can be opened by moving each set of louvers towards one of the active end caps.

What is claimed is:

1. An architectural covering comprising a headrail with an active end cap, a plurality of carriers, including a most trailing carrier, spacers interconnecting the carriers, slats supported by the carriers, and a releasable end stop, the end stop comprising:

a longitudinally-movable release plate in the head rail that is between said active end cap and a trailing spacer of a most trailing carrier and that is affixed to a trailing end of the trailing spacer of the most trailing carrier; and a longitudinally-extending, flexible resilient tongue that is on the active end cap and is adapted to detachably hold the release plate against movement of the release plate away from the active end cap with longitudinal movement of the spacers and carriers away from the active end cap.

2. The covering of claim 1 comprising a pair of tongues that are on a laterally-extending first end surface of an end plug of the active end cap; the first end surface being adjacent to the release plate.

3. The covering of claim 2 wherein the tongues are vertically aligned with each other and with a pair of vertically-aligned, horizontal surfaces of the release plate.

4. The covering of claim 3 wherein each tongue has a hook at a leading edge and the hooks extend towards each other.

5. The covering of claim 4 wherein at least one of the tongues can be flexed vertically so that its hook is moved vertically, whereby a horizontal surface of the release plate can then be moved longitudinally over or under the hook to attach or detach the release plate and the end plug.

6. The covering of claim 5 wherein a laterally-extending second end surface of the release plate has a pair of mating, vertically aligned, first notches adjacent the horizontal surfaces where the first notches can be engaged and held by the hooks by moving the release plate longitudinally against the end plug.

7. The covering of claim 6 wherein both of the tongues are highly flexible, so that the tongues can be flexed vertically to move their hooks vertically apart, whereby the horizontal surfaces of the release plate can then be moved longitudinally over or under the hooks to attach or detach the release plate from the hooks by pushing on one vertical side of the release plate in a direction longitudinally away from the active end cap.

8. The covering of claim 5 wherein both of the tongues are highly flexible, so that the tongues can be flexed vertically to move their hooks vertically apart, whereby the horizontal surfaces of the release plate can then be moved longitudinally over or under the hooks to attach or detach the release plate from the hooks by pushing on one vertical side of the release plate in a direction longitudinally away from the active end cap.

9. The covering of claim 1 wherein a downwardly- and laterally-extending tab is on the underside of the release plate.

10. The covering of claim 9 wherein the tab extends below the head rail.

11. The covering of claim 9 wherein there is a longitudinally-extending hole through the release plate to accommodate draw cords.

12. The covering of claim 9 wherein there is a longitudinally-extending smooth second notch through a rear portion of the release plate to accommodate a tilt rod mounting member.

13. The covering of claim 9 wherein there is a frontally-extending projection on the front of the release plate and wherein the bottom of the projection is horizontal and smooth, so that it can slide along a longitudinally-extending track on the front of the interior of the head rail when the release plate is moved longitudinally.

14. The covering of claim 2 wherein a downwardly- and laterally-extending tab is on the underside of the release plate and extends below the head rail.

15. The covering of claim 3 wherein a downwardly- and laterally-extending tab is on the underside of the release plate and extends below the head rail.

16. The covering of claim 4 wherein a downwardly- and laterally-extending tab is on the underside of the release plate and extends below the head rail.

17. The covering of claim 5 wherein a downwardly- and laterally-extending tab is on the underside of the release plate and extends below the head rail.

18. The covering of claim 6 wherein a downwardly- and laterally-extending tab is on the underside of the release plate and extends below the head rail.

19. The covering of claim 7 wherein a downwardly- and laterally-extending tab is on the underside of the release plate and extends below the head rail.

* * * * *